US005541474A

United States Patent [19]

LaPeruta et al.

[11] Patent Number: 5,541,474

[45] Date of Patent: Jul. 30, 1996

[54] GETTER SPRING ASSEMBLY FOR A COLOR CATHODE-RAY TUBE

[75] Inventors: Richard LaPeruta, Lititz; Richard E. Roland, Conestoga; Stephen T. Opresko, Lancaster, all of Pa.

[73] Assignee: Thomson Consumer Electronics, Inc., Indianapolis, Ind.

[21] Appl. No.: 345,731

[22] Filed: Nov. 22, 1994

[51] Int. Cl.[6] ..... H01J 19/70

[52] U.S. Cl. ..... 313/481; 313/559

[58] Field of Search ..... 313/481, 553, 313/556, 560, 561, 562, 559; 417/48, 51

[56] References Cited

U.S. PATENT DOCUMENTS

| | | | |
|---|---|---|---|
| 3,792,300 | 2/1974 | Benda et al. | 313/85 R |
| 3,979,633 | 9/1976 | Davis et al. | 313/481 |
| 4,134,041 | 1/1979 | della Porta et al. | 313/481 |
| 4,153,857 | 5/1979 | Delsing et al. | 313/481 |
| 4,221,991 | 9/1980 | Speigel | 313/481 |
| 4,225,805 | 9/1980 | Smithgall et al. | 313/481 |
| 4,230,966 | 10/1980 | Compen | 313/481 |
| 4,342,662 | 8/1982 | Kimura et al. | 252/181.4 |
| 5,397,958 | 3/1995 | Na | 313/481 X |

*Primary Examiner*—Sandra L. O'Shea
*Assistant Examiner*—Ashok Patel
*Attorney, Agent, or Firm*—Joseph S. Tripoli; Dennis H. Irlbeck; Vincent J. Coughlin, Jr.

[57] ABSTRACT

The present invention relates to a color CRT 10 having an evacuated envelope 11 includes a funnel 15 sealed at one end to a faceplate panel 12. A luminescent screen 22 is provided on an interior surface of the panel. A color selection electrode assembly 27 is disposed within the envelope in proximity to the screen. An internal magnetic shield 30, having an exterior surface 32, is secured to the color selection electrode assembly and is spaced from and extends along at least a portion of the funnel. A getter spring assembly 33 is disposed within the envelope to deposit a film of getter spring material onto the exterior surface 32 of the magnetic shield 30. The getter assembly 33 is improved by being detachably attached to the color selection electrode assembly 27 and prevented from rotating by an orientation plate 60 having a projection 70 with a flat contact surface that bears against the color selection electrode assembly.

9 Claims, 4 Drawing Sheets

GETTER SPRING ASSEMBLY FOR A COLOR CATHODE-RAY TUBE

The present invention relates to a color cathode-ray tube (CRT) having a getter spring assembly disposed in proximity to an exterior surface of an internal magnetic shield and, more particularly, to an improved getter spring assembly with reduced variability in the positioning thereof.

BACKGROUND OF THE INVENTION

A color CRT utilizes a evaporable getter assembly comprising a getter cup affixed to a support spring to provide a deposit, or film, of gas-adsorbing material essential for adsorbing the residual gas molecules within the tube, in order to ensure adequate life of the CRT. It is desirable that the getter deposit not be provided on an interior surface of a color selection electrode or on a surface of a luminescent screen. Getter deposits on the interior surface of the color selection electrode are undesirable because such deposits may overlie heat dissipative and/or X-Ray suppressing coatings provided thereon, thus interfering with the operations of the coatings. Additionally, portions of a getter deposit directed onto the interior surface of the color selection electrode will pass through the apertures or openings therein and be deposited onto portions of an aluminum layer overlying the luminescent screen. The getter material on the aluminum layer absorbs energy from the electron beams incident thereon, causing a decrease in screen brightness in the underlying areas of the screen. This results in an objectionable non-uniform appearance of the screen. To prevent the flashed getter material from being deposited onto the interior surface of the color selection electrode and the screen, it is known to spot weld the getter support spring directly to a frame of the color selection electrode, so that the getter cup is positioned in proximity to an exterior surface of an internal magnetic shield. Such positioning of the getter cup restricts the deposit of the flashed, gas-adsorbing getter material to the exterior surface of the magnetic shield. However, a drawback of welding the getter spring to the frame of the color selection electrode is that, usually, the spring is manually positioned against the frame and then spot welded in place. Such a process is not only time consuming, but also results, frequently, in variability of both the lateral positioning of the getter cup as well as the rotational orientation of the getter cup within the CRT. In order to flash the material within the getter cup, the internal location of the cup must be determined to ensure that the RF coil, used to heat the getter cup to the flashing temperature, is properly positioned with respect to the cup. To ensure correct lateral positioning of the RF coil, a metal detector is used to locate the getter cup. However, such an expediency will not ensure proper coupling of the RF energy of the coil to the getter cup and complete flashing of the getter material, if the getter cup is rotated with respect to the coil and does not lie fiat against and substantially parallel to the internal sidewall of the glass envelope. Accordingly, a need exists for a getter spring assembly that provides a means for reproducibly positioning the getter cup within the CRT to ensure correct positioning and orientation, which is necessary to achieve more constant getter deposition and yield, thereby improving productivity and quality control, while eliminating product variability, without increasing the cost of the CRT.

SUMMARY OF THE INVENTION

The present invention relates to a color CRT having an evacuated envelope comprising a funnel sealed at one end to a faceplate panel. A luminescent screen is provided on an interior surface of the panel. A color selection electrode assembly is disposed within the envelope in proximity to the screen. An internal magnetic shield is secured to the color selection electrode assembly and is spaced from and extends along at least a portion of the funnel. A getter spring assembly is disposed within the envelope to deposit a film of getter material onto an exterior surface of the magnetic shield. The getter spring assembly is improved by being detachably attached to the color selection electrode assembly and being prevented from rotating by positioning means.

BRIEF DESCRIPTION OF THE DRAWINGS

The invention will now be described in greater detail, with relation to the accompanying drawings, in which.

DETAILED DESCRIPTION OF THE PREFERRED EMBODIMENT

Figure 1:
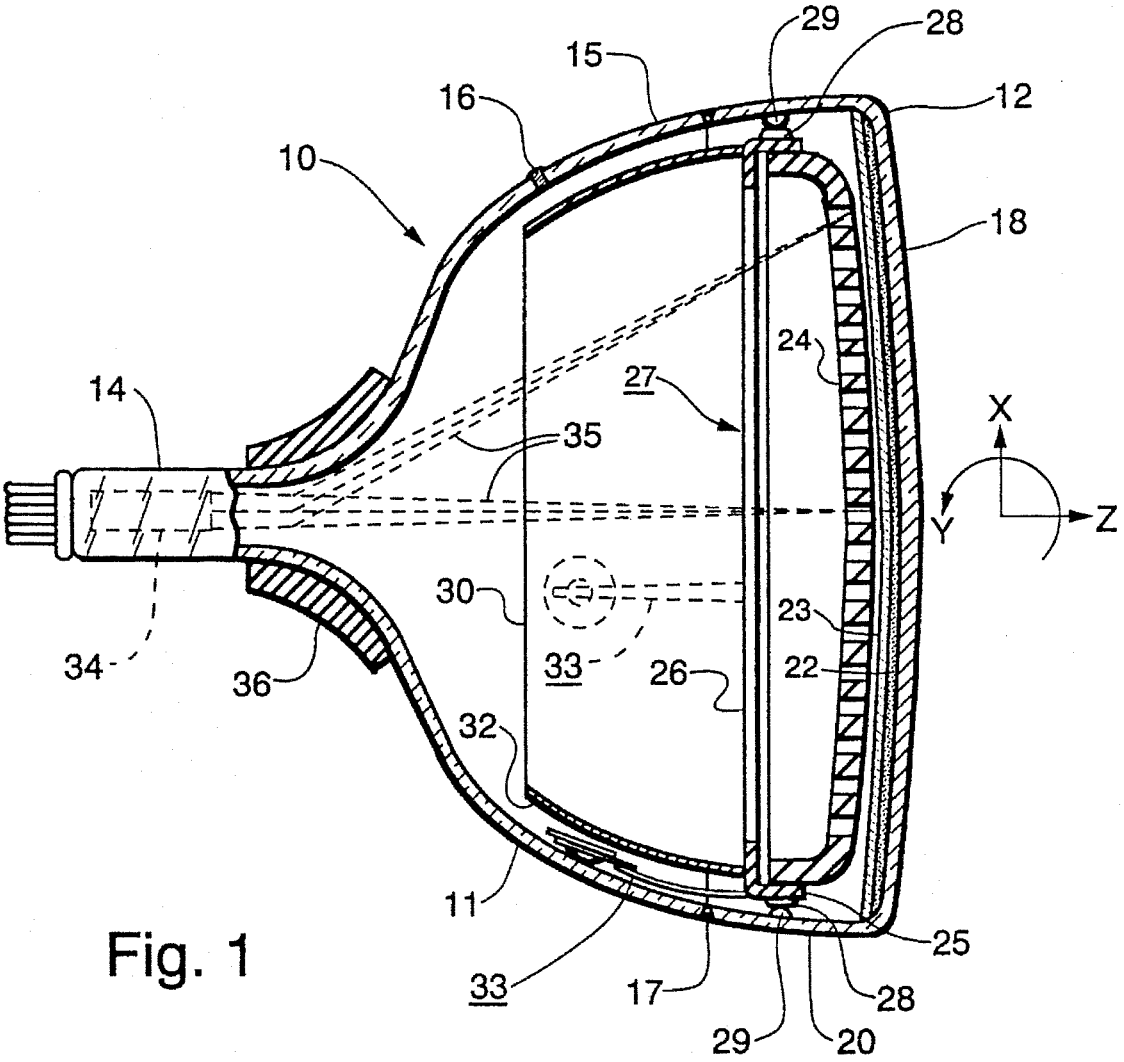
FIG. 1 is a plan view, partially in axial section, of a color CRT made according to the present invention.

FIG. 1 shows a rectangular color CRT 10, such as a TV picture tube or a monitor, having an evacuated glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried on the inner surface of the faceplate 18. Preferably, the screen 22 is a line screen, with the phosphor lines arranged in triads, each triad including a phosphor line of each of the three primary colors, red, blue, and green. The phosphor lines extend substantially perpendicular to the high frequency raster line scan of the CRT, i.e., normal to the plane of FIG. 1. Alternatively, the screen may be a dot screen. A thin conductive layer 23, preferably of aluminum, overlies the screen 22 and provides a means for applying a uniform potential thereto. A color selection electrode 24, such as a focus mask or a conventional shadow mask, having a multiplicity of openings therethrough, is mounted, or otherwise secured, to a first flange 25 of an L-shaped frame 26. The color selection electrode 24 and the frame 26, in combination, comprise a color selection electrode assembly 27. The color selection electrode assembly 27 is removably mounted by means of a plurality of resilient springs 28 to support studs 29 embedded in the sidewall 20 of the faceplate panel 12. An internal magnetic shield (IMS) 30 is secured to a second flange 31 of the frame 26. The IMS 30 has an exterior surface 32 that extends along at least a portion of the interior surface of the funnel 15. At least one novel getter spring assembly 33 is detachably attached to the frame 26 of the color selection electrode assembly 27 and is disposed between the funnel 15 and the exterior surface 32 of the IMS 30. An electron gun 34, shown schematically by the dashed lines in FIG. 1, is centrally mounted within the neck 14 to generate and direct three electron beams 35 along convergent paths through the color selection electrode 24 to the screen 22.

The tube of FIG. 1 is designed to be used with an external magnetic deflection yoke, such as yoke 36, that is disposed around the envelope at the funnel-to-neck junction. When activated, the yoke 36 subjects the three beams 35 to magnetic fields that cause the beams to scan horizontally and vertically in a rectangular raster over the screen 22. The initial plane of deflection (at zero deflection) is at about the middle of the yoke 36.

Figure 2:
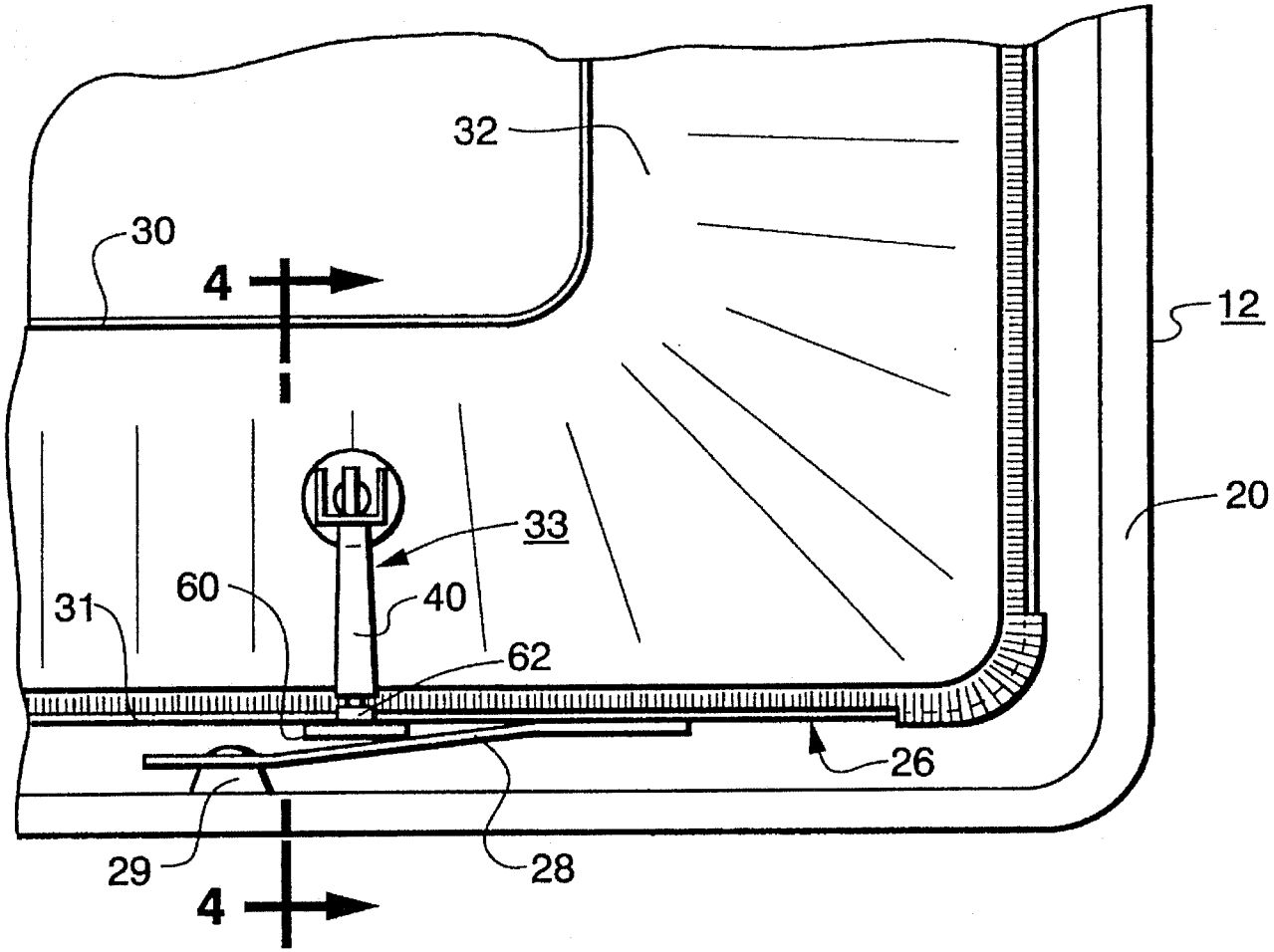
FIG. 2 is a bottom view of a quadrant of the faceplate panel, color selection electrode assembly, and the novel getter spring assembly of the tube of FIG. 1.
Figure 3:
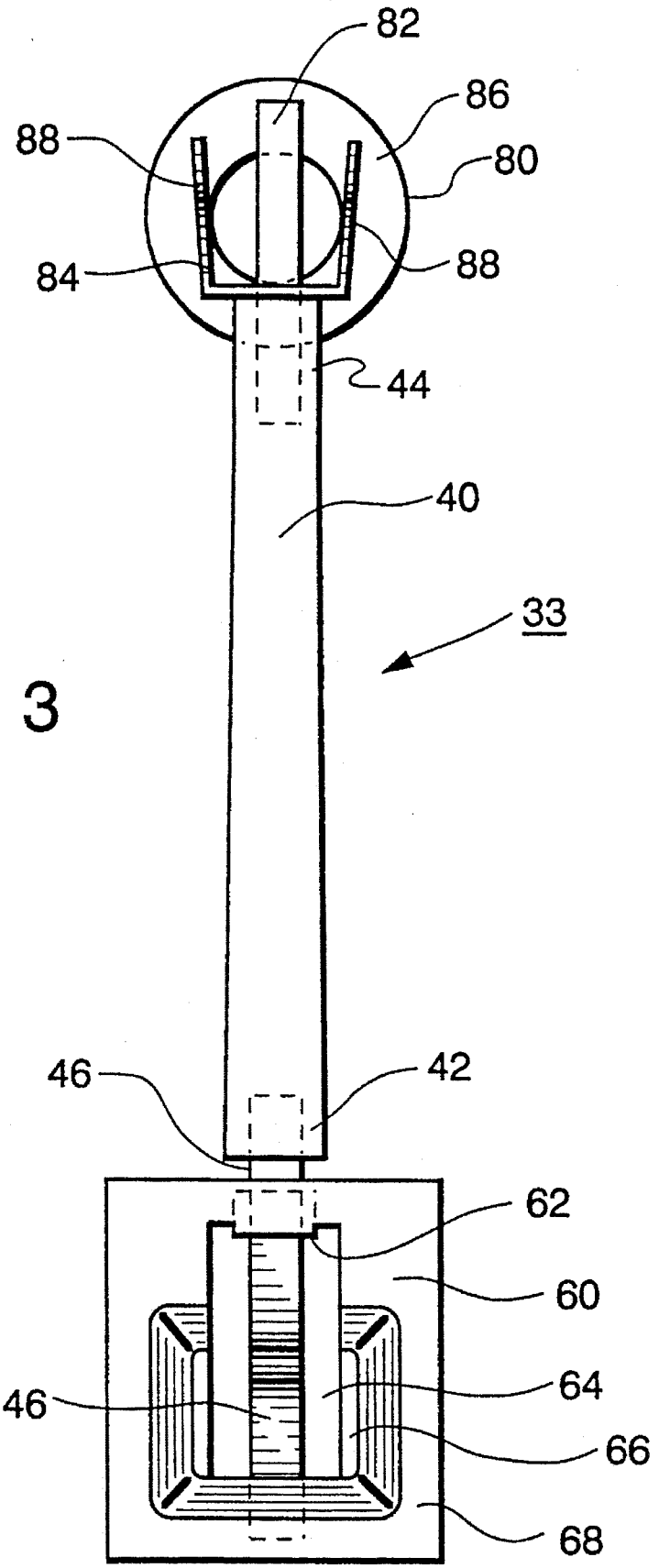
FIG. 3 is a perspective view of the novel getter spring assembly.
Figure 4:
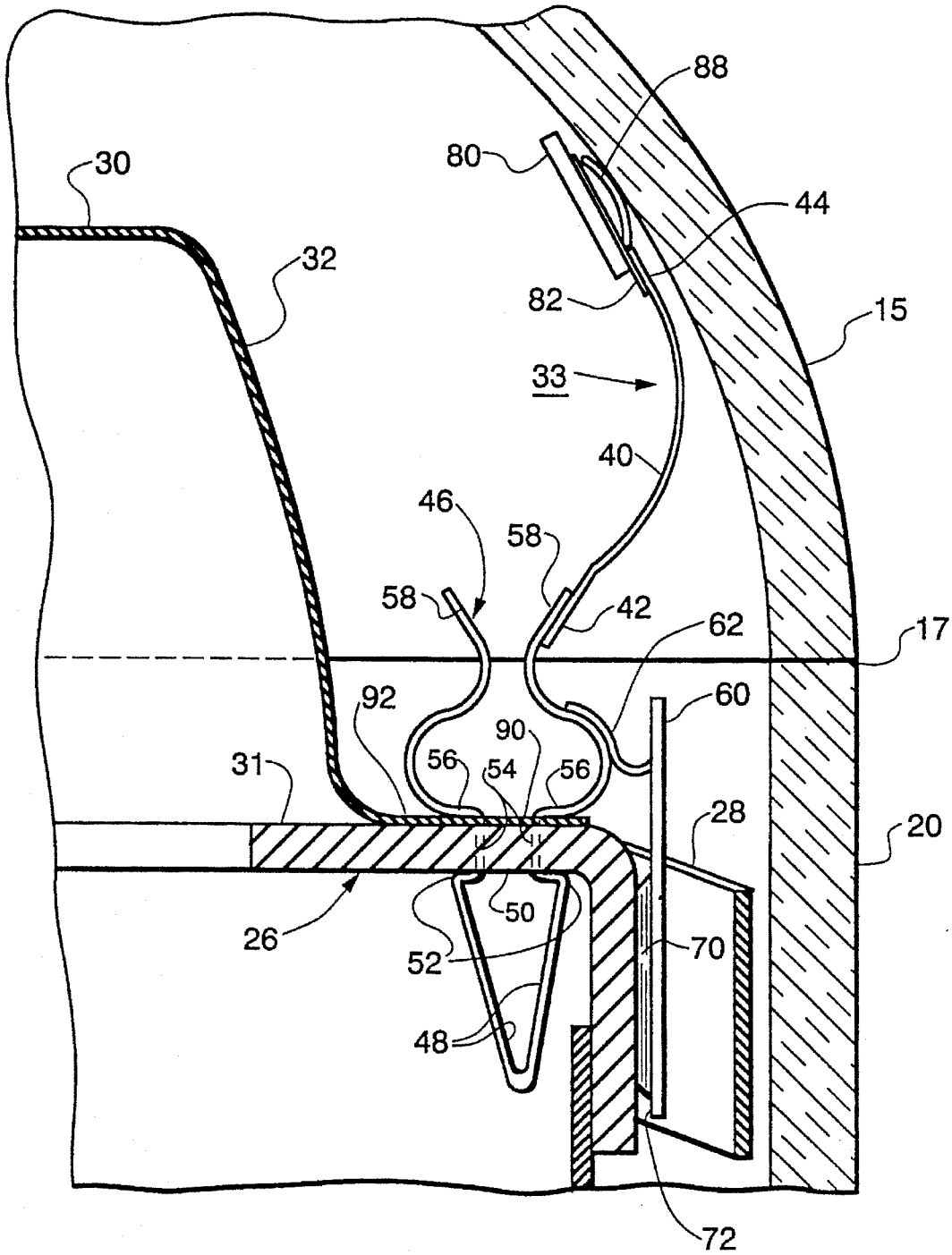
FIG. 4 is a sectional view of the color selection electrode assembly and the novel getter spring assembly taken along line 4—4 of FIG. 2.

As shown in FIGS. 2–4, the novel evaporable getter spring assembly 33 includes a getter spring 40 having a proximal end 42 and a distal end 44. The proximal end 42 of the getter spring is attached to one end of a resilient fastening member, such as a coupling clip, 46, shown in detail in FIG. 4. The coupling clip has a substantially V-shaped portion 48 which is inserted into an opening 50 provided through the second flange 31 of the frame 26. While only one opening 50 is shown in FIG. 4, a plurality of similar openings are provided around the periphery of the second flange 31 to secure the IMS 30 thereto. The clip 46 has a pair of first shoulders 52 which contact the underside of the second flange 31 of the frame 26. Neck portions 54 extend from the shoulders 52 of the clip and contact a surface portion of the second flange 31 bordering the opening 50. A pair of second shoulders 56 are contiguous with the neck portions 54 and contact the top side of the second flange 31, to lock the clip 46 within the opening 50. End portions 58 extend from the second shoulders 56 of the clip 46. The clip 46 may be detached from the opening 50 in the frame 26 by compressing the end portions 58 which, in turn, compress the neck portions 54 and permit the first shoulders 52 to be withdrawn through the opening 50. The proximal end 42 of the getter spring 40 is attached, for example by welding, to one of the end portions 58. An orientation plate 60, that functions as a positioning means, has an integral connecting tab 62 that also is attached, for example by welding, to the end portion 58 of the clip 46 to which the getter spring 40 is attached. As shown in FIG. 3, the orientation plate 60 has an aperture 64 therethrough so that the clip 46 can be seen through the aperture, in order to facilitate aligning the clip 46 with the opening 50 in the flange 31. A recess 66 is provided in one surface 68 of the plate 60. A projection 70 of the recess 66, shown in FIG. 4, extends outwardly from the opposite surface 72 of the orientation plate 60. The projection 70 provides a flat contact surface that bears against the outside surface of the first flange 25 of the frame 26 and positions the getter spring assembly, thereby preventing the rotation of the getter spring assembly 33 within the CRT 10. A conventional getter cup 80, having getter material (not shown) therein, is secured to the distal end 44 of the getter spring 40 by means of a support strap 82 that is welded therebetween. A sled 84 is attached to a closed back surface 86 of the getter cup 80. The sled has a pair of runners 88 that are in contact with, and orient the getter cup 80 substantially parallel to the inner surface of the funnel 15. Alternatively, the getter spring and the coupling clip may be formed as a unitized, resilient member with the proximal end thereof being configured as the coupling clip portion. The distal end of the unitized, resilient member would be secured to the getter cup 80, as described above. As shown in FIG. 4, the clip 46 of the getter spring assembly 33 also may be utilized to secure the IMS 30 to the second flange 31 of the frame 26 by extending the clip 46 through an opening 90 formed through the outer lip 92 of the IMS. It is within the scope of this invention to provide more than one novel getter spring assembly 33 in order to satisfy the requirements for maintaining a suitably low pressure within the evacuated envelope 11.

What is claimed is:

1. In a color cathode-ray tube having an evacuated envelope comprising a funnel sealed at one end to a faceplate panel with a luminescent screen on an interior surface thereof; a color selection electrode assembly disposed within said envelope and in proximity to said screen; an internal magnetic shield secured to said color selection electrode assembly, said magnetic shield having an exterior surface extending along at least a portion of said funnel and being spaced therefrom; and at least one evaporable getter spring assembly within said envelope to deposit a film of evaporated getter material therefrom onto said exterior surface of said magnetic shield; said getter spring assembly comprises a resilient member having a proximal end and a distal end, a getter cup being attached to said distal end, and said proximal end including a fastening member; wherein the improvement comprises said evaporable getter spring assembly being detachably attached to said color selection electrode assembly by said fastening member and prevented from rotating by an orientation plate secured to said fastening member and in contact with said color selection electrode assembly.

2. The tube as described in claim 1, wherein said resilient member comprises a getter spring, said fastening member being attached to said proximal end thereof.

3. The tube as described in claim 1, wherein said fastening member of said getter spring assembly being configured to be detachably attached to at least a frame of said color selection electrode assembly.

4. The tube as described in claim 1, wherein said fastening member of said getter spring assembly being configured also to be detachably attached to said magnetic shield.

5. The tube as described in claim 1, wherein said orientation plate abuts said color selection assembly to prevent rotation of said getter spring assembly.

6. In a color picture tube having an evacuated envelope comprising a funnel sealed at one end to a faceplate panel with a luminescent screen on an interior surface thereof; a color selection electrode attached to a first flange of a frame, said color selection electrode being disposed within said envelope in proximity to said screen; a magnetic shield secured to a second flange of said frame, said magnetic shield having an exterior surface extending along at least a portion of said funnel and being spaced therefrom; and at least one evaporable getter spring assembly within said envelope to deposit a film of evaporated getter material therefrom onto said exterior surface of said magnetic shield; said getter spring assembly comprises a resilient member having a proximal end and a distal end, a getter cup being attached to said distal end, and said proximal end including a fastening member; wherein the improvement comprises said evaporable getter spring assembly being detachably attached at least to said frame of said color selection electrode assembly by said fastening member and prevented from rotating by an orientation plate secured to said fastening member and in contact with said frame of said color selection electrode assembly.

7. The tube as described in claim 6, wherein said resilient member comprises a getter spring, said fastening member being attached to said proximal end thereof.

8. The tube as described in claim 6, wherein said fastening member of said getter spring assembly being configured to be detachably attached to at least said second flange of said frame of said color selection electrode, and a projection of said orientation plate abutting said first flange of said frame to prevent rotation of said getter spring assembly.

9. The tube as described in claim 6, wherein said fastening member of said getter device being configured also to be detachably attached to said magnetic shield.

* * * * *